US007990038B2

(12) United States Patent
Greuel et al.

(10) Patent No.: US 7,990,038 B2
(45) Date of Patent: Aug. 2, 2011

(54) SEGMENTED DIELECTRIC BARRIER DISCHARGE LAMP

(75) Inventors: Georg Greuel, Roetgen (DE); Wolfgang Schiene, Wuerselen (DE); Norbert Braun, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 455 days.

(21) Appl. No.: 11/722,889

(22) PCT Filed: Jan. 2, 2006

(86) PCT No.: PCT/IB2006/050001

§ 371 (c)(1),
(2), (4) Date: Jun. 27, 2007

(87) PCT Pub. No.: WO2006/072892

PCT Pub. Date: Jul. 13, 2006

(65) Prior Publication Data

US 2008/0093971 A1 Apr. 24, 2008

(30) Foreign Application Priority Data

Jan. 7, 2005 (EP) ..... 05100073

(51) Int. Cl.
*H01J 1/62* (2006.01)

(52) U.S. Cl. ..... 313/484

(58) Field of Classification Search ..... 313/484, 313/485, 491, 634

See application file for complete search history.

(56) References Cited

U.S. PATENT DOCUMENTS

| | | | | |
|---|---|---|---|---|
| 4,983,881 | A * | 1/1991 | Eliasson et al. | 313/607 |
| 5,386,170 | A * | 1/1995 | Kogelschatz | 313/17 |
| 5,557,112 | A | 9/1996 | Csoknyai et al. | |
| 6,340,862 | B1 * | 1/2002 | Lecheler et al. | 313/484 |
| 6,633,109 | B2 | 10/2003 | Falkenstein | |
| 2002/0089275 | A1 * | 7/2002 | Falkenstein | 313/29 |

FOREIGN PATENT DOCUMENTS

| | | | |
|---|---|---|---|
| DE | 9217438 | U1 | 2/1993 |
| DE | 10209191 | A1 | 9/2003 |
| EP | 1048620 | A1 | 11/2000 |
| EP | 1154461 | A1 | 11/2001 |
| JP | 2002042736 | A | 2/2002 |
| JP | 2002316041 | A | 10/2002 |

* cited by examiner

*Primary Examiner* — Toan Ton
*Assistant Examiner* — Zachary Snyder

(57) ABSTRACT

The subject of the present invention is a dielectric barrier discharge (DBD-) lamp (1) for generating and emitting ultraviolet radiation comprising: —a housed discharge gap (3), whereby the housing has at least two walls, whereby at least one of the walls is a dielectric wall and at least one of the walls has an at least partly transparent part, a filling located inside the discharge gap (3), at least two electrical contacting means for electrical contacting associated with at least the two walls, respectively, whereby the discharge gap (3) is formed by at least two discharge sub-volumes (7) and/or discharge sub-areas (8) differing in at least one of their discharge parameters for realizing at least two dominant emission regimes and/or one emission regime with different radiant intensities and a method for producing said DBD-lamp (1).

4 Claims, 4 Drawing Sheets

SEGMENTED DIELECTRIC BARRIER DISCHARGE LAMP

The present invention relates to a dielectric barrier discharge (DBD-) lamp for generating and emitting ultraviolet radiation comprising: a housed discharge gap, whereby the housing has at least two walls, whereby at least one of the walls is a dielectric wall and at least one of the walls has an at least partly transparent part, a filling located inside the discharge gap, at least two electrical contacting means for electrical contacting associated with at least the two walls, respectively, and a method of producing such a DBD-lamp.

Dielectric barrier discharge lamps are generally known and are used in a wide area of applications, where light waves of a certain wavelength have to be generated for a variety of purposes. Some applications are for example generating UV radiation with wavelengths of about 180 nm to 380 nm for industrial purposes such as waste water treatment, disinfections of drinking water, dechlorination or production of ultra pure water.

Well known dielectric barrier discharge lamps are used for example in flat lamps for liquid crystal display (LCD) backlighting, as cylindrical lamps for photocopiers, and as coaxial lamps for surface and water treatment purposes.

DBD-lamps could be generally of any form. The lamps known from the prior art are typically of a coaxial form consisting of an outer tube and an inner tube melted together on both sides forming an annular discharge gap and having relatively large diameters in respect to the width of the discharge gap. Other types of lamps are of a dome-shaped form consisting of an outer tube, which is closed on one side, and an inner tube, which is also closed on one side, melted together on the non-closed side forming an annular discharge gap and having relatively large diameters in respect to the width of the discharge gap.

EP 1048620, EP 1154461, and DE 10209191 show coaxial dielectric barrier discharge lamps with a suitable phosphor layer coating for generating VUV- or UVC-light.

EP 1048620B1 describes a DBD-lamp, which is suited for fluid disinfection and comprises luminescent layers, in this case phosphor layers, which are deposited onto the inner surfaces of the lamp envelope, in this case made of two quartz tubes, which define a discharge volume or a discharge gap. In this case the discharge gap is filled with xenon gas at a certain pressure, which emits a primary radiation as soon as a gas discharge, especially a dielectric barrier discharge, is initiated inside the discharge gap. This primary plasma radiation with an emitting maximum of about 172 nm is transformed by the luminescent layer into the desired wavelength range for example of about 180 nm to about 380 nm. According to the specified applications, this range can be reduced to a range of 180 nm-190 nm in case of the production of ultra pure water or to a range of 200 nm-280 nm if used for disinfections of water, air, surfaces and the like. The phosphor layer emits a primary radiation in the UV-C range.

In DE 102 09 191 A1 and EP 1154461 A1 similar constructions or arrangements are shown. All of them have in common, that the luminescent or phosphor layer emits only one radiation that is a primary radiation.

A luminescent layer is generally realized by a phosphor coating, transferring the excimer radiation generated inside the discharge gap—so called volume radiation—into the phosphor specific emission spectrum, for example VUV-, UVC-, UVA-, visible, or infrared spectrum.

U.S. Pat. No. 5,557,112 shows a fluorescent lamp having multiple zones with different ultraviolet radiation characteristics along its length having a tube with a first fluorescent coating for producing ultraviolet radiation of substantially uniform intensity extending over a first finite length of the tube adjacent one end and a second fluorescent coating extending over a second finite length of the tube adjacent its other end thereof producing ultraviolet radiation of a substantially uniform intensity and having radiation characteristics which are different from those produced in the first finite length. Generally, the UVB intensity and UVB/UVA ratio will be increased. This lamp is ideally suited for use in tanning chambers to provide uniform tanning by providing a higher intensity and a higher UVB/UVA ratio for radiation in the area of the head.

This well-known fluorescent lamp has the drawback that it divides a phosphor layer of a low-pressure discharge lamp into two parts with different phosphor material. This lamp is rather a low-pressure-lamp discharge lamp and therefore is completely different from a high-pressure discharge lamp as the DBD-lamp of the present invention. Furthermore this division is only possible in length direction of the lamp. Yet further no UVC radiation is possible.

U.S. Pat. No. 6,633,109 shows a DBD-lamp used in fluid treatment systems, where the irradiated fluid is used as a low voltage outer electrode instead of a metallic wire mesh and which can be controlled by the applied voltage frequency and shape, gas pressure, gas composition, and gas gap distance.

This well known DBD-lamp has the drawback that it works only with an electricity conductive fluid for treatment, because this fluid works as a grounded counter electrode. Furthermore this DBD-lamp emits only one narrow-banded or quasi-monochromatic UV light and does not realize at least two dominant emission regimes in one lamp.

DE 9217438 U shows a neon tube with at least two parts in length direction having different phosphor layers.

This well known neon tube has the drawback as well as U.S. Pat. No. 5,557,112 that this lamp is a low-pressure-lamp discharge lamp and therefore is completely different from a high-pressure discharge lamp as the DBD-lamp of the present invention.

It is an object of the present invention to provide a high efficient DBD-lamp with two or more dominant emission regimes realized in one single DBD-lamp.

This issue is addressed by a dielectric barrier discharge (DBD-) lamp for generating and emitting ultraviolet radiation comprising: a housed discharge gap, whereby the housing has at least two walls, whereby at least one of the walls is a dielectric wall and at least one of the walls has an at least partly transparent part, a filling located inside the discharge gap, at least two electrical contacting means for electrical contacting associated with at least the two walls, respectively, whereby the discharge gap is formed by at least two discharge sub-volumes and/or discharge sub-areas differing in at least one of their discharge parameters for realizing at least two dominant emission regimes and/or one emission regime with different radiant intensities.

A discharge sub-volume according to the present invention is defined by its filling gas pressure, filling gas composition, geometry including length, diameter, width, gap distance, glass thickness, and outer electrode. All of these parameters are capable of modifying the volume discharge inside the particular sub-volume of the lamp.

A discharge sub-area according to the present invention is defined by its fluorescence layer, or geometry including length, diameter, and width. All of these parameters are capable of modifying the conversion of the volume radiation inside the gap into a surface radiation within the luminescent layer(s).

A DBD-lamp according to the present invention comprises at least two, or more individual discharge sub-volumes or sub-volumes and/or discharge sub-areas or sub-areas.

The geometrical shape of the lamp can be of any shape but preferably is cylindrically, especially in co-axial form, flat, or of any arbitrary shape feasible for the particular application.

A DBD-lamp according to this invention comprises an outer part and an inner part. The outer part comprises the envelope of the inner part, whereby the inner part comprises the means for generating the radiation and the emitting light of the DBD-lamp. The inner part of a DBD-lamp according to this invention is structural arranged from the inside to the outside as follows:

The heart of the DBD-lamp is the discharge gap with the filling. This discharge gap is formed by surrounding walls, whereby at least one of these walls is made of a dielectric material and at least one of the walls is at least partly transparent. These walls may be covered at their inner surfaces with a luminescent layer, especially a luminescent coating layer for transferring the radiation generated inside the discharge gap into a radiation with a different, especially higher wavelength, which is then emitted to the surrounding of the DBD-lamp. At their outer surfaces the walls have two corresponding means for electrical contacting for supplying the energy to generate a gas discharge inside the discharge gap and thus for generating a radiation inside the discharge gap.

For generating UV-light or more generally radiation, a discharge volume or a discharge gap is needed, surrounded and/or formed by at least one dielectric wall. The material for the dielectric wall(s) is selected from the group of dielectric materials, preferably quartz, glass or ceramic. The material for the dielectric walls have to be arranged such, that the needed radiation can pass at least a part of the outer and/or the inner dielectric wall for applying the radiation to the surroundings of the DBD-lamp and irradiates the volume or the medium, which surrounds the outer lamp surface. Each wall has an inner and an outer surface. The inner surface of each wall is directed to and facing the discharge gap. The distance between the inner surface and the outer surface of one wall defines the wall thickness, which in some special cases can vary. At the outer surfaces or near the outer surfaces the means for electrical contacting or electrodes are applied or located. They supply or provide the energy in form of electricity for generating the gas discharge inside the discharge gap and thus generating the radiation inside the discharge gap.

For applying the radiation, the electrode or electrical contacting means at/on at least one of the walls, preferably the contacting means at or near the outer wall has to be arranged such, that radiation from the inside can pass the corresponding electrode. Thus said electrode has to be at least partly transparent, for example in form of a grid, especially when that electrode is arranged adjacent on the outer surface of the outer wall. In that case, in that the electrode is spaced to the outer surface of the outer wall, for example in the case of water treatment, the electrode can be of any suitable material for providing electricity in the corresponding environment.

Of course other means than electrodes can be used for example if the DBD-lamp is used for fluid or water treatment. In this case the DBD-lamp is at least at one side—the inner wall side or the outer wall side—at least partly surrounded by that water or fluid. The surrounding water or fluid than serves as electrical contacting means, whereby again electrodes transfer the electricity to the water or fluid. It is also possible to generate plasma or in consequence radiation by non-capacitive means, by means of induction and/or even by use of microwaves. So the present invention is not limited to electrodes as electrical contacting means. The electrical contacting means are thus associated with the corresponding wall.

According to the present invention, the outer and/or the inner electrode may be segmented with an individual electrical connection for each electrode segment. Thus a DBD-lamp with distinct sub-areas or sub-discharge areas is defined. Each sub-area may have its own individual electrical driving scheme to allow for different discharge characteristics and hence plasma conditions inside the gap underneath each sub-area. By adjustment of the driving scheme, the lamp radiation can be modified in intensity and—depending on the gas filling—emission characteristic.

Preferably the lamp geometry is selected from the group comprising flat lamp geometry, coaxial lamp geometry, dome lamp geometry, a planar lamp geometry and the like. For industrial purposes coaxial DBD-lamps with relatively large diameters compared to the diameter of the discharge gap or the distance between the inner surfaces of the corresponding inner and outer wall or dome-shaped coaxial lamps are preferably used, to achieve a lamp with a large effective area for fluid and surface treatment.

One preferably application of the present invention is that the lamp geometry is basically based on two cylindrical bodies arranged such that one cylindrical body envelopes the other cylindrical body. More preferably both bodies are made of quartz glass but also other materials comprising glass, ceramic, and/or metal could be used for at least one cylindrical body. In the case that one body is not of a transparent material for the lamp radiation, that non-transparent body has a directing means preferably in form of a reflective coating layer. Further it is possible that the outer cylindrical body or cylindrical tube is made or at least mainly made of a material containing or being of quartz glass, whereby the inner cylindrical tube is mainly made of a metallic or metal containing material having a reflective coating layer. That means, the present invention is also applicable for DBD-lamps with only one dielectric wall forming the discharge gap.

Preferably the DBD-lamp has electrical contacting means, wherein the electrical contacting means comprise one counter electrode, whereby this counter electrode is at least partly made of a metallic material for grounding electricity.

DBD-lamps work with an electrode and a counter electrode. As mentioned before, the counter electrode can be of any conductive material for grounding electricity introduced by the electrode. Preferably the counter electrode is metallic or at least contains metallic material.

One advantage of the present invention is that at least two sub-volumes of the DBD-lamp differ by at least one of their characterizing parameters being capable of modifying the volume discharge inside the sub-volume. The DBD-lamp according to the present invention comprises at least two sub-volumes or at least two sub-areas. The at least two sub-volumes differ to each other by at least one parameter defining the sub-volume, such that e.g. two dominant emission regimes are realized in one DBD-lamp, or e.g. one emission regime with different radiant densities. Such dominant emission regimes could be at VUV (wavelength around 172 nm) and UV-C, or at UV-C and UV-A. Of course other variations are possible as well as more than two dominant emission regimes. The number of possible dominant emission regimes is limited by the availability of suitable gas fillings and fluorescent layers. Other limitations of the number of possible dominant emission regimes do not exist, so that any combination aside the aforementioned limitations are possible.

The sub-volumes differ in one of their characterizing parameters. The characterizing parameters defining the sub-volumes comprise filling gas pressure, filling gas composition, sub-volume geometry comprising sub-volume-length, sub-volume diameter, sub-volume width, sub-volume-form, sub volume gap distance, sub-volume wall thickness, and sub-volumes-outer electrode. Usually a DBD lamp only has one discharge gap with only one dominant emission regime and therefore with only one volume, discharge volume or gap. By having discharge sub-volumes differing in at least one parameter several dominant emission regimes are adjustable, or several radiant densities of one emission regime are adjustable. The sub-volumes could be hermetically closed or can be open. Of course different gas pressure and composition could only be realized by having closed sub-volumes.

The DBD-lamp according to the present invention can also comprise several discharge sub-areas. Preferably the DBD-lamp has at least two discharge sub-areas, wherein the discharge sub-areas differ by at least one of their characterizing parameters being capable of modifying the conversion of the volume radiation inside the gap into a surface radiation within the fluorescence layer(s).

As mentioned in connection with said discharge sub-volumes the DBD-lamp according to the present invention may also comprise at least two sub areas. The at least two sub-areas differ to each other by at least one parameter defining the sub-area, such that two dominant emission regimes are realized in one DBD-lamp. As mentioned before such dominant emission regimes could be at VUV (wavelength around 172 nm) and UV-C, or at UV-C and UV-A. Of course other variations are possible as well as more than two dominant emission regimes. The number of possible dominant emission regimes is limited by the availability of suitable gas fillings and fluorescent layers. Other limitations of the number of possible dominant emission regimes do not exist, so that any combination aside the aforementioned limitations are possible.

The characterizing parameters define the discharge sub-areas. Preferably the characterizing parameters are type of fluorescence layer, and sub-area geometry comprising sub-area length, sub-area diameter, and sub-area width.

Usually a DBD-lamp only has one discharge gap with only one dominant emission regime and therefore with only one volume, discharge volume or gap. By having discharge sub-areas differing in at least one parameter several dominant emission regimes are adjustable.

Of course discharge sub-volume(s) and discharge sub-area (s) can be combined so that a DBD-lamp could for example comprise two discharge sub-volumes and one discharge area, or one discharge volume and two discharge sub-areas, or two discharge sub-volumes and two discharge sub-areas, and so on.

A further object of the present invention is to provide a method for producing a high efficient DBD-lamp with two or more dominant emission regimes in one single DBD-lamp.

This issue is addressed by a method for producing a DBD-lamp comprising the steps of producing and arranging all single parts together, wherein the steps producing and arranging all single parts together comprises the step of defining discharge sub-volumes and/or discharge sub-areas for realizing at least two dominant emission regimes, so that a segmented DBD-lamp is realized. The method of producing a non-segmented DBD-lamp is generally known. That well known method comprises the steps producing and arranging all single parts together. By having the additional step of defining discharge sub-volumes and/or sub-areas a segmented DBD-lamp can be realized.

Preferably the step of defining comprises a suitable method for defining discharge sub-volumes and/or discharge sub-areas selected from the group of technologies comprising: putting quartz parts of different dimensions together for building up a volume used for discharge, using partial coating technologies, realizing of closed sub-volumes inside the lamp and filling closed sub-volumes with gases of different composition and/or different pressure, realizing structured metallization on the lamp body and/or realizing structured electrodes on the lamp body. Of course any other suitable technology or method could be used for defining sub volumes and/or areas.

The DBD-lamp according to the present invention could be used in a wide variety of applications. One possible application of a DBD-lamp according to the present invention is given in the field of generating and emitting a radiation preferably in the UV range for the treatment of water, air and/or surfaces, especially for disinfection, decontamination and/or purification treatment. The lamp according to present invention comprises for example two sub-discharge areas, defined by partial coating of a coaxial lamp with Xenon gas as main filling constituent. The partial coating comprises a phosphor with dominant emission in the UV-C range of wavelengths. The uncoated sub-area of the lamp radiates at around 172 nm of wavelengths, the coated part in or around the UV-C range.

Preferably the DBD-lamp is incorporated in a system and being used in one or more of the following applications: fluid and/or surface treatment of hard and/or soft surfaces, preferably cleaning, disinfection and/or purification; liquid disinfection and/or purification, food and/or beverage treatment and/or disinfection, water treatment and/or disinfection, wastewater treatment and/or disinfection, drinking water treatment and/or disinfection, tap water treatment and/or disinfection, production of ultra pure water, reduction of the total organic carbon content of a liquid or a gas, gas treatment and/or disinfection, air treatment and/or disinfection, exhaust gases treatment and/or cleaning, cracking and/or removing of components, preferably inorganic and/or organic compounds, cleaning of semiconductor surfaces, cracking and/or removing of components from semiconductor surfaces, cleaning and/or disinfection of food supplements, cleaning and/or disinfection of pharmaceuticals.

The method of manufacturing such a DBD-lamp and/or defining segments can include the following steps: after local heating of the glass surface, where a change in the geometry is needed, the glass wall is pushed in with a heat resistant tool. Alternatively the change in geometry can also be made for example on the inner tube by pushing the glass outward. In this case the inner tube will touch the outer tube on the inside.

These and other aspects of the invention will be apparent from and elucidated with reference to the embodiments described hereinafter.

FIG. 1*a* shows schematically in a longitudinal and cross sectional view the housing of a coaxial DBD-lamp.

FIG. 1*b* shows schematically in a longitudinal and cross sectional view a typical metallization on said quartz tubes according to FIG. 1*a*.

FIG. 1*c* shows schematically in a longitudinal and cross sectional view a luminescent phosphor layer on the outside of the inner tube and on the inside of the outer tube.

The FIG. 2 to 9 show typical embodiments of DBD-lamps according to the present invention. For reasons of simplicity a co-axial DBD-lamp comprising inner and outer quartz tube as in FIG. 1*a* to 1*c* will be used in all fig., to illustrate typical applications. DBD-lamps can be formed in any shape that allows to realize a gas-filled gap between one or two transparent wall materials, where at least one of the walls is electrically insulating. Transfer of the invention related features to other than co-axial DBD-lamps is straight forward.

Figure 7:
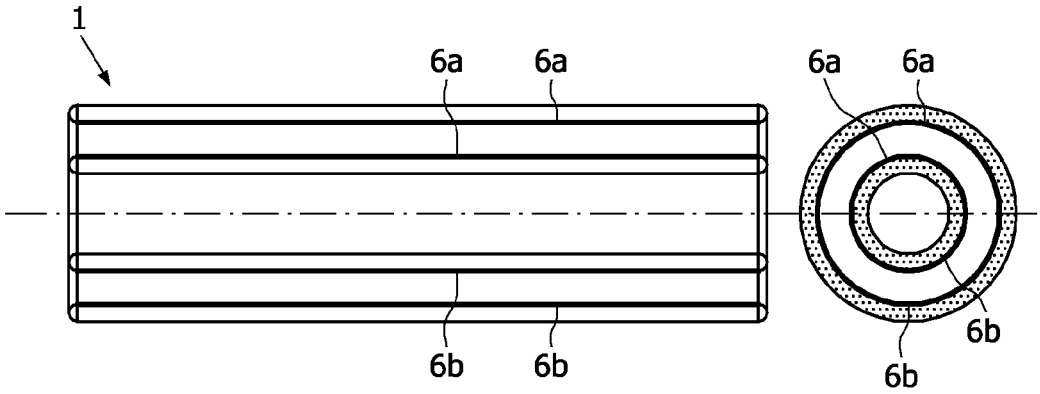
FIG. 7 shows schematically in a longitudinal and cross sectional view a DBD-lamp with two sub-areas defined by two different luminescent layers having no radial symmetry.
Figure 8:
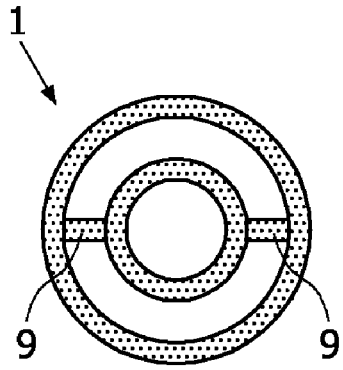
FIG. 8 shows schematically in a cross sectional view a DBD-lamp with two sub-volumes extending over the total length of the lamp.
Figure 9:
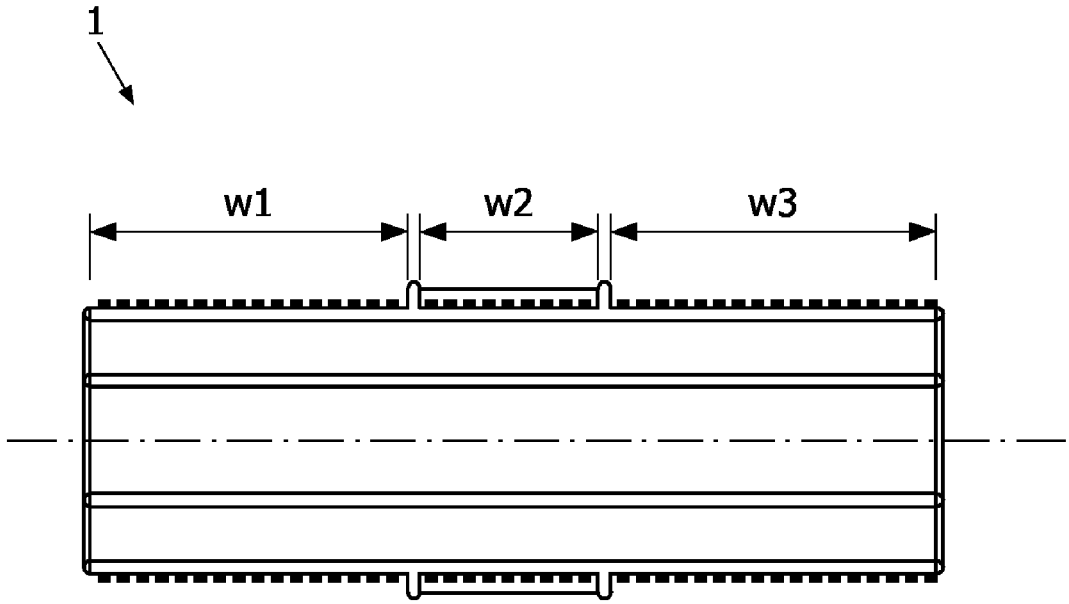
FIG. 9 shows schematically in a longitudinal sectional view a DBD-lamp with three sub-volumes defined by structuring of the electrode applied on the outer tube.

In FIG. 2 to 6 the radial symmetry of the lamp has been preserved. In FIG. 7 to 9 a segmented DBD-lamp is shown without radial symmetry.

Figure 1A:
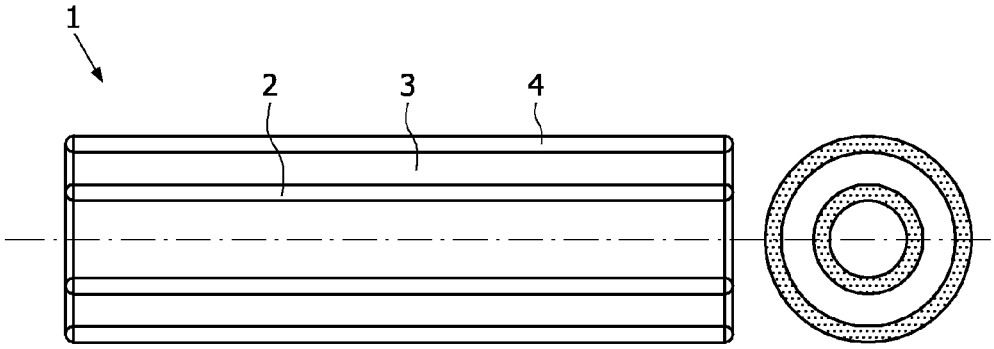

FIG. 1*a* shows schematically in a longitudinal (left) and a cross sectional (right) view a DBD-lamp 1 having a housing, comprising an inner tube 2, a discharge gap 3, and an outer tube 4. Either the inner tube 2 or the outer tube 4 or both are made of quartz glass to allow transmission of the radiation generated inside the lamp. The outer wall or outer tube 4 and the inner wall or inner tube 5, both form the discharge gap 3, are arranged toward each other with a constant distance d. The wall thickness of the outer tube 4 and the inner tube 2 is about equal.

Figure 1B:
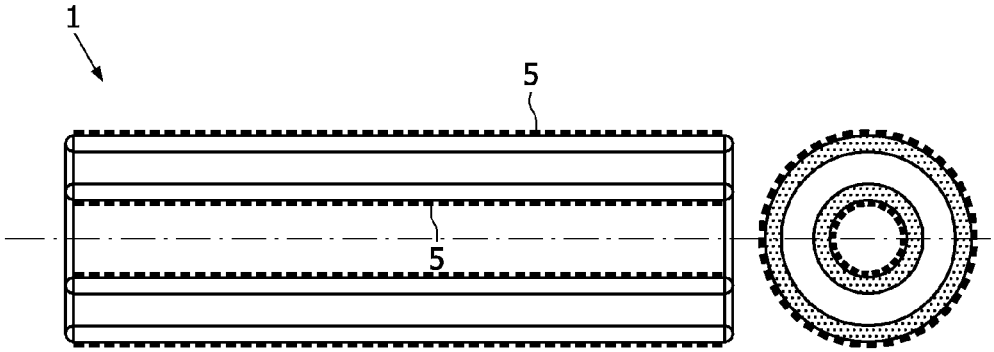

FIG. 1*b* shows schematically in a longitudinal and a cross sectional view a typical electrical contacting means 5, The electrical contacting means are in form of a metallization on both quartz tubes of FIG. 1*a* or more precisely in form of a metallic pattern applied to both tubes, the inner tube 2 and the outer tube 4. The metallization serves as electrode and/or as counter electrode or in general as electrical contacting means 5. The metallization is used to connect the electrical power supply (not shown) to the DBD-lamp 1. In case of metallic electrodes, liquid electrodes—for example process water in case of DBD-lamps 1 being used for water treatment—can be used as well.

Figure 1C:
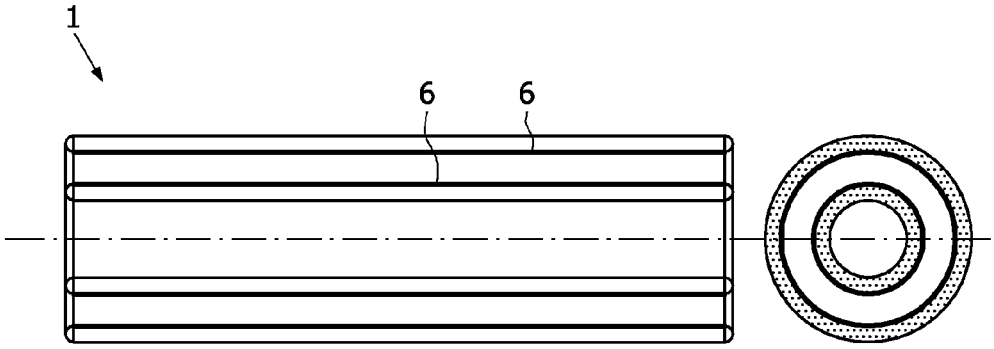

FIG. 1*c* shows schematically in a longitudinal and in a cross sectional view a DBD-lamp 1 according to FIG. 1*a* having a luminescent layer 6 or more precisely a luminescent phosphor layer on the outside of the inner tube 2 and on the inside of the outer tube 4, that is adjacent to the discharge gap 3 or the discharge volume. Both layers are radiated by the volume discharge inside the discharge gap 3, thus transferring at least part of the volume radiation into a surface radiation.

Figure 2:
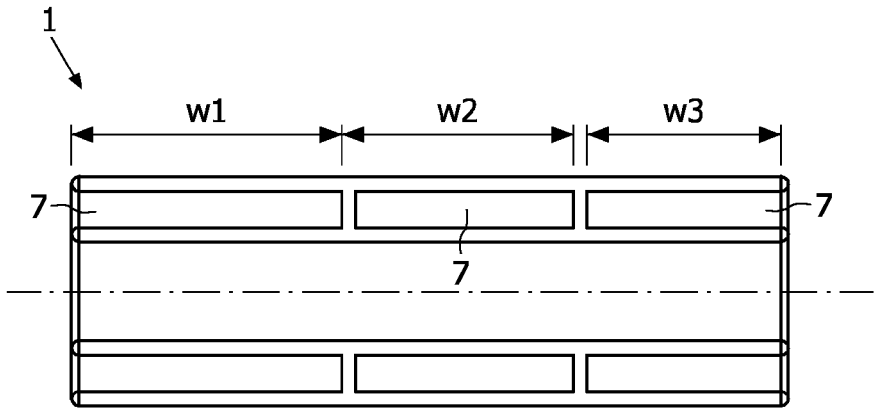
FIG. 2 shows schematically in a longitudinal sectional view a DBD lamp with three segments defined by three discharge sub-volumes separated by a wall. Each sub-volume has its individual filling gas pressure and/or composition.

FIG. 2 shows schematically in a longitudinal sectional view a DBD-lamp 1 having three segments. The three sub-volumes 7 have the width w1, w2, and w3, which in this case differ. The three sub-volumes 7 are hermetically closed or sealed, which is reached by walls separating the three sub-volumes 7. Each sub-volume 7 has an individual filling. The filling, that is the gas filling, the gas pressure and/or the luminescent coating may be individually adjusted within each sub-volume 7.

Figure 3:
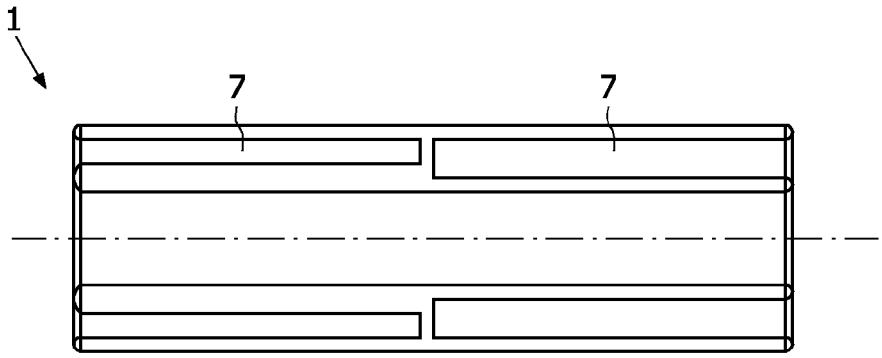
FIG. 3 shows schematically in a longitudinal sectional view a DBD-lamp with two sub-volumes separated by a wall and characterized by different thickness of the inner lamp tube.

FIG. 3 shows schematically in a longitudinal sectional view a DBD-lamp 1 with two sub-volumes volumes 7. The sub-volumes 7 are separated by a wall. Each sub-volume 7 has a different gap geometry, which is realized by variation of the wall thickness of the inner tube of said DBD-lamp 1. A modification of the gap geometry in each sub-volume 7 could also be realized by variation of the outer tubes wall thickness.

Figure 4:
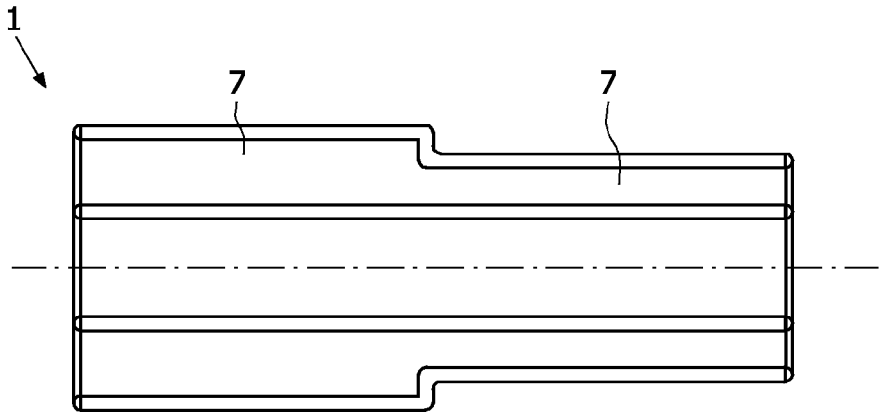
FIG. 4 shows schematically in a longitudinal sectional view a DBD-lamp with two sub-volumes, not separated by a wall, with different diameter of the outer lamp tube.

FIG. 4 shows schematically in a longitudinal sectional view a DBD-lamp 1 having two sub-volumes 7. The two sub-volumes 7 are not separated by a wall so that both sub-volumes 7 are connected with each other. Said two sub-volumes 7 are defined by variation of the diameter of the outer tube 4. In the same way the diameter of the inner tube 2 may be changed to define sub-volumes 7 inside the lamp. Each sub-volume 7 is thus characterized by an individual gap geometry.

Figure 5:
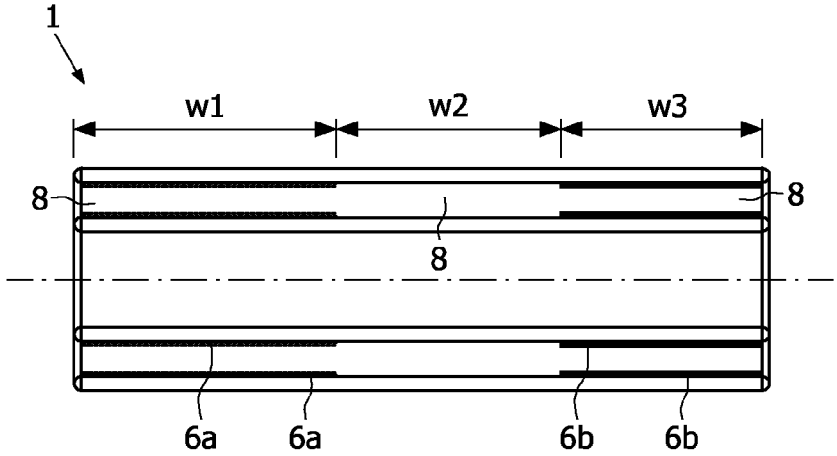
FIG. 5 shows schematically in a longitudinal sectional view a DBD-lamp with three distinct sub-discharge areas.

FIG. 5 shows schematically in a longitudinal sectional view a DBD-lamp 1 having three distinct sub-areas 8. The conditions inside the gap or the volume, that is for example the volume radiation of the discharge, are identical over the total axis of the lamp. However, in the first, that is starting left, sub-area 8 having a width w1, a first luminescent layer is applied. In the second sub-area 8 having a width w2, no luminescent layer 6*a* is applied. In the third sub-area 8 a second luminescent layer 6*b* is applied. The second layer may differ from the first layer in type, material etc.

Figure 6:
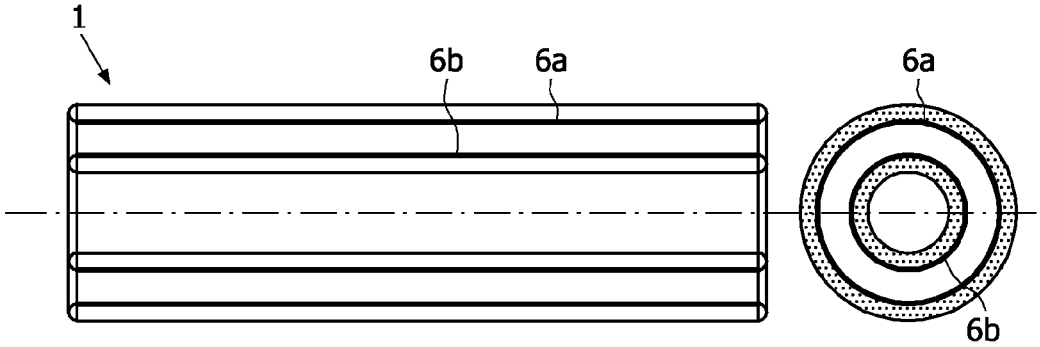
FIG. 6 shows schematically in a longitudinal and cross sectional view a DBD-lamp with two sub-areas defined by two different luminescent layers.

FIG. 6 shows schematically in a longitudinal and a cross sectional view a DBD-lamp 1 having two sub-areas 8 defined by two different luminescent layers 6*a* and 6*b*. A first luminescent layer 6*a* is applied on the inside of the outer tube. A second luminescent layer 6*b* is applied on the outside of the inner tube.

FIG. 7 shows schematically in a longitudinal and a cross sectional view a DBD-lamp 1 having two sub-areas 8. On the upper half of the lamp, more precisely on the upper half of the two cylinders there is a first luminescent layer 6*a*. On the lower half of the lamp or more precisely on the lower half of the two cylinders there is a second luminescent layer 6*b*. Both layer differ at least in one characteristic feature, that is type, material etc.

FIG. 8 shows schematically in a cross sectional view a DBD-lamp 1 having two sub-volumes 7. The sub-volumes 7 are defined by a sealing material 9, which is needed to hermetically seal the DBD-lamp 1.

Sub-volumes can also be defined by confinement of the electrodes—or in general electrical contacting means—to a certain part of the lamp surface or the outer tube surface. In this way, the discharge conditions underneath each electrode may vary for example to tune the power density of the volume discharge. Multiple electrode configurations and driving modes are possible, in case that the electrodes are structured on the outer tube as well as the inner tube.

FIG. 9 shows schematically in a longitudinal sectional view a DBD-lamp 1 having three sub-volumes 7. First (starting on the left side) sub-volume has width w1, second sub-volume has width w2, and third sub-volume has width w3. The three sub-volumes 7 are defined by structuring of the electrical contacting means, here the electrode applied on the outer tube. The electrodes on the outer tube are separated from each other by means of material protrusions on the outer tube.

LIST OF REFERENCE NUMBERS

1 dielectric barrier discharge lamp (DBD-lamp)
2 inner tube

3 discharge gap or volume
4 outer tube
5 electrical contacting means
6 luminescent layer
6 *a* first luminescent layer
6 *b* second luminescent layer
7 (discharge) sub-volume
8 (discharge) sub-area
9 sealing material
w sub-volume/area width

The invention claimed is:

1. A highly efficient, unitary dielectric barrier discharge (DBD) lamp for providing at least two dominant emission regimes comprising:

a first wall;

a second wall positioned in spaced-apart relation from the first wall, a discharge volume between the first wall and the second wall sealed and fillable with a gas, a distance between facing surfaces of the first and the second wall defining a discharge gap, wherein at least one of the first and the second wall comprises a dielectric wall and at least one of the first and the second wall is at least partially transparent;

a separating wall positioned to divide the discharge volume into two sub-volumes within the discharge volume, wherein a width of a section of the first wall defining one sub-volume is different from a width a section of the first wall defining the other sub-volume, the widths of the sections of the first wall defining the two sub-volumes sufficiently different from each other to effect different dominant emission regimes for each of the sub-volumes; and a first and a second electrode in electrical contact with the first and the second wall, respectively, for delivering electrical power thereto.

2. The DBD lamp recited in claim 1, wherein the first and the second wall comprise concentric cylinders.

3. A method for providing two dominant emission regimes with the use of a unitary, highly efficient, dielectric barrier discharge (DBD) lamp comprising:

positioning a first wall in spaced-apart relation from a second wall filling a discharge volume between the first wall and the second wall with a gas;

defining two sub-volumes within the discharge volume with the use of a separating wall, a width of a section of the first wall defining one sub-volume different from a width of a section of the first wall defining the other sub-volume, the the widths of the sections of the first wall defining the two sub-volumes sufficiently different from each other to effect different dominant emission regimes for each of the sub-volumes; and positioning a first and a second electrode in electrical contact with the first and the second wall, respectively; and delivering electrical power to the first and the second electrode to create two different dominant emission regimes.

4. A method for treating matter for achieving at least one of disinfection, decontamination, and purification thereof comprising:

generating ultraviolet radiation at at least two dominant emission regimes with the use of a unitary dielectric barrier discharge lamp comprising:

a first wall;

a second wall positioned in spaced-apart relation from the first wall, a discharge volume between the first wall and the second wall sealed and fillable with a gas, a distance between facing surfaces of the first and the second wall defining a discharge gap;

a separating wall positioned to divide the discharge volume into two sub-volumes within the discharge volume, wherein a width of a section of the first wall defining one sub-volume is different from a width of a section of the first wall defining the other sub-volume, the widths of the sections of the first wall defining the two sub-volumes sufficiently different from each other to effect different dominant emission regimes for each of the sub-volumes; and a first and a second electrode in electrical contact with the first and the second wall, respectively, for delivering electrical power thereto; and exposing the matter to be treated to the generated ultraviolet radiation.

* * * * *